US005565044A

United States Patent [19]

Kim et al.

[11] Patent Number: 5,565,044

[45] Date of Patent: Oct. 15, 1996

[54] THERMAL REFININGLESS HOT-ROLLED STEEL AND METHOD OF MAKING SAME

[75] Inventors: Dae Y. Kim, Seoul; Jeong W. Jo, Incheon; Yoon S. Jo; Jong S. Kim, both of Seoul, all of Rep. of Korea

[73] Assignees: Daewoo Heavy Industries, Ltd., Incheon; Kia Steel Co., Ltd., Seoul, both of Rep. of Korea

[21] Appl. No.: 412,797

[22] Filed: Mar. 29, 1995

[30] Foreign Application Priority Data

Mar. 31, 1994 [KR] Rep. of Korea ..... 94-6831

[51] Int. Cl.[6] ..... C21D 8/00

[52] U.S. Cl. ..... 148/320; 148/541; 148/547

[58] Field of Search ..... 148/541, 547, 148/320

[56] References Cited

U.S. PATENT DOCUMENTS

| | | |
|---|---|---|
| 4,851,054 | 7/1989 | Fukuzuka et al. . |
| 4,930,909 | 6/1990 | Murakami et al. . |
| 5,017,335 | 5/1991 | Bramfitt et al. . |

FOREIGN PATENT DOCUMENTS

| | | |
|---|---|---|
| 0300598 | 1/1989 | European Pat. Off. . |
| 93-2742 | 4/1993 | Rep. of Korea . |
| 93-3643 | 5/1993 | Rep. of Korea . |
| 2246579 | 2/1992 | United Kingdom . |

*Primary Examiner*—Deborah Yee
*Attorney, Agent, or Firm*—Lowe, Price, LeBlanc & Becker

[57] ABSTRACT

A thermal refiningless, hot-rolled steel exhibits impact strength in excess of 10kgf·m/cm$^2$ and contains, expressed in terms of weight percent, 0.30–0.50% carbon, 0.15–0.60% silicon, 0.80–1.60% manganese, up to 0.02% phosphorus, up to 0.015% sulfur, 0.07–0.20% vanadium, 0.015–0.06% aluminum, 0.005–0.015% nitrogen, up to 0.0015% oxygen, the balance iron and unavoidable impurities. The steel of the above-identified property and composition is produced by casting a steel product of predetermined cross-sectional shape; heating the steel product up to a temperature of 1,100°–1,250° C.; hot-rolling the heated steel product at a final rolling temperature of 850°1,000° C.; normalizing the hot-rolled steel product at a temperature of 880°–950° C.; and cooling the normalized steel product down to 300° C. at a cooling speed of 5°–100° C./min.

7 Claims, No Drawings

THERMAL REFININGLESS HOT-ROLLED STEEL AND METHOD OF MAKING SAME

FIELD OF THE INVENTION

The instant invention is generally directed to a thermal refiningless hot-rolled steel, and more particularly to a hot-rolled, normalized steel which does not require costly thermal refining treatment but exhibits satisfactory mechanical strength with highly improved toughness and clearness. In another aspect, the invention pertains to a method of making a hot-rolled steel of the type having increased toughness and minimized surface defect, without going through any conventional quenching and tempering treatment.

DESCRIPTION OF THE PRIOR ART

As generally known in the steel-making art, the typical process of making steel products for use as mechanical parts or structures involves hot-rolling a medium carbon, low-alloyed steel preform under a controlled temperature and then subjecting the hot-rolled steel to a thermal refining treatment to thereby achieve mechanical strength required in a particular application. As used herein, the term "thermal refining" refers that the hot-rolled steel is subjected to reheating, quenching and tempering in an effort to improve mechanical properties. Normalizing is excluded from the terminology "thermal refining" in the present specification.

The thermal refining treatment tends to render the steel-making process intricate and costly, which would necessarily lead to an increased price of final products. More importantly, failure to carry out the thermal refining treatment in a proper condition may yield steel products of poor quality that cannot meet the requirement in an intended use. To avoid the drawbacks noted above, use has been made of a thermal refiningless hot-rolled steel that possesses substantially the same mechanical properties as those of the thermally refined, i.e., quenched and tempered, steel. While the thermal refiningless, hot-rolled steel has proven to provide a variety of advantages over the thermally refined one, its use is confined to such an application where the toughness requirement is less severe than the strength requirement. This is mainly because the thermal refiningless steel lacks toughness intrinsically.

An attempt has been made in the past to add a controlled amount of manganese to the thermal refiningless, as-rolled steel for the sake of toughness improvement. Unfortunately, however, an increase in the manganese content should adversely affect the machinability of the hot-rolled steel. As an alternative, adding such microalloy elements as sulfur, lead and bismuth has been proposed to obviate any degradation machinability, which in turn, however, results in an unacceptable drop in toughness. Moreover, these microalloy elements have a tendency to undergo premature plastic deformation in the hot-rolling process, thus leaving unwanted linear inclusions within the steel structure.

Korean Post-examination Patent Publication No. 93-3643 dated May 8, 1993 teaches an as-rolled, high toughness steel containing, expressed in terms of percent by weight, 0.35–0.55% carbon, 0.15–0.45% silicon, 0.01–0.075% aluminum, 0.60–1.55% manganese, up to 0.05% sulfur, up to 0.15% niobium plus vanadium, 0.2923 titanium-0.02% nitrogen, up to 0.03% titanium, 0.00001–0.04% microalloy element selected from the group consisting of calcium, rare earth metals such as cerium or tellurium and misch metal, the balance iron and impurities. The term "misch metal" refers to an alloy consisting of a crude mixture of cerium, lanthanum, and other rare earth metals obtained by electrolysis of the mixed chlorides of the metals dissolved in fused sodium chloride.

Despite the addition of various microalloy elements, the steel taught in the '643 publication fails to enhance the toughness to an appreciable extent and, on the contrary, gives rise to an attendant problem that the overly added microalloy elements would cause streak flaw in the steel structure, hampering surface treatment to be done subsequently. Throughout the specification, the term "streak flaw" is intended to mean visible linear defects that may appear on a machined steel surface. Among the causes of such streak flaw are pin holes, blow holes, non-metallic inclusions and other alien matters.

Korean Post-examination Patent Publication No. 93-2742 dated Apr. 9, 1993 discloses a high toughness, hot-rolled steel comprising, in weight percent, 0.30–0.45% carbon, 0.15–0.35% silicon, 1.0–1.55% manganese, up to 0.050% sulfur, up to 0.30% chromium, 0.01–0.05% aluminum, 0.05–0.15% vanadium plus niobium, 0.01–0.03% titanium, 0.0005–0.003% boron, 0.2923 titanium-0.02% nitrogen, the balance iron and impurities unavoidably contained in a steel-making process. Also disclosed in the '742 publication is a method of making a thermal refiningless, high toughness steel comprising the steps of: melting raw material of the composition set forth immediately above, under a typical melting condition, to produce a steel ingot; hot-rolling the steel ingot into a predetermined thickness at over $A_3$ transformation temperature but less than 1300° C.; and cooling the hot-rolled steel from 800°–950° C. down to 500–550° C. at a cooling speed of 10–150° C./min.

With the method referred to above, it would be quite vexing to control the rolling temperature and the cooling speed in a precise manner. Furthermore, the ingot casting often results in a decreased yield rate and a reduced impact strength, as compared to a continuous steel casting.

SUMMARY OF THE INVENTION

It is therefore an object of the :invention to provide a thermal refiningless, hot-rolled steel which has minimized surface defect and enhanced mechanical strength and toughness with no need to add expensive microalloy elements such as niobium, titanium, chromium, rare earth metal and misch metal.

Another object of the invention is to provide a method of making a thermal refiningless, hot-rolled steel of good mechanical strength, toughness and clearness at a high yield rate without i having to employ a controlled rolling process.

In one aspect, the invention resides in a thermal refiningless, hot-rolled steel exhibiting impact strength in excess of 10 kgf·m/cm$^2$ and comprising, expressed in terms of weight percent, 0.30–0.50% carbon, 0.15–0.60% silicon, 0.80–1.60% manganese, up to 0.02% phosphorus up to 0.015% sulfur, 0.07–0.20% vanadium, 0.015–0.06% aluminum, 0.005–0.015% nitrogen, up to 0.0015% oxygen, the balance iron and unavoidable impurities.

To further increase high temperature property, yield strength and toughness, optional addition of 0.02–0.15% molybdenum may be preferable.

In another aspect, the invention provides a method of making a thermal refiningless, hot-rolled steel exhibiting impact strength in excess of 10kgf·m/cm$^2$ and comprising, expressed in terms of weight percent, 0.3–0.50% carbon, 0.15–0.60% silicon, 0.80–1.60% manganese, up to 0.02% phosphorus, up to 0.15% sulfur, 0.07–0.20% vanadium, 0.015–0.06% aluminum, 0.005–0.015% nitrogen, up to 0.0015% oxygen, the balance iron and unavoidable impurities, the method comprising the steps of: casting a steel product of predetermined cross-sectional shape; heating the steel product up to a temperature of 1,100°–1,250° C.; hot-rolling the heated steel product at a final rolling temperature of 850°–1,000° C.; normalizing the hot-rolled steel product at a temperature of 880°–950° C.; and cooling the normalized steel product down to 300° C. at a cooling speed of 5°–100° C./min.

DETAILED DESCRIPTION OF THE PREFERRED EMBODIMENT

As summarized in the foregoing, the thermal refiningless, hot-rolled steel consists essentially of, in weight percent, 0.30– 0.50% carbon, 0.15–0.60% silicon, 0.80–1.60% manganese, up to 0.02% phosphorus, up to 0.015% sulfur, 0.07–0.20% vanadium, 0,015–0.06% aluminum, 0.005–0.015% nitrogen and up to 0.0015% oxygen. The balance is iron and unavoidable impurities customarily contained in the course of making a steel. If desired, 0.02–0.15% molybdenum may be optionally added to the inventive steel. It should be appreciated that the content of alloy elements in the specification and the claims is expressed in terms of weight percent unless specifically mentioned otherwise.

Set forth below are major behavior and recommended range of addition of the alloy elements that constitute the instant hot-rolled steel. Carbon is essential to secure enough mechanical strength, the content of which can vary from 0.30 to 0.50%, preferably 0.41 to 0.44%. Below 0.30%, it becomes difficult to achieve sufficient strength and acceptable quenching property. In excess of 0.50%, toughness and weldability are deteriorated to a practically undesirable extent.

Not only do silicon act as a deoxidizer by way of forming $SiO_2$ in combination with oxygen present in the molten steel, but also it serves to strengthen ferritic matrix. The silicon content is preferably from 0.15 to 0.60%, most preferably 0.24 to 0.%. Sufficient strength cannot be achieved in the range of less than 0.15%, while more than 0.60% silicon content results in reduced toughness and undesirable; creation of non-metallic inclusions, e.g., Mns, $Al_2O_3$ and $SiO_2$.

Manganese, as desulfurizer, is able to improve hardenability and strength of the steel in the same manner as carbon does. To attain strength comparable to that of the thermally refined steel containing carbon in the above-noted range, it is desirable or even necessary to add manganese in an mount of more than 0.80%. Exceedingly high manganese content, however, might produce a considerable mount of bainitic matrix Which is known to reduce toughness. Overly addition of manganese may also increase peglite grain size, thereby shortening fatigue life as well as deteriorating roachinability and weldability. For this reason, the preferred manganese content is from 0.80 to 1.60%, most preferably 0.16 to 0.39%.

Sulfur coacts with manganese to form MnS that can improve machinability but it may leave fatal defects on the surface treated steel surface. Moreover, sulfur may injure hot workability when it comes to combine with iron. In particular, sulfur in the form of segregation can become a stress concentration point from which crack begins to occur. In addition to the above, sulfur is a main cause of producing streak flaw, especially in case where metal plating is carried out to enhance wear resist:race. For the reason stated above, the sulfur content has to be maintained as small an amount as possible, preferably below 0.015%, most preferably up to 0.009%.

Phosphorus tends to create segregation and, in some instances, form a so-called "ghost line" which is attributable to creation of a fiber-like metallurgical structure. Excessive addition of phosphorus should degrade impact strength and make the steel quite brittle, thus adversely affecting toughness. In view of this, the phosphorus content has to be confined to not more than 0.02%, preferably 0.016%.

Vanadium is required to, on one hand, promote precipitation of vanadium carbide and carbon nitride and, on the other hand, achieve substantially the same level of strength as in the thermally refined steel. Strength enhancement does not take place if the vanadium content exceeds a critical range. For this reason and in light of the economy, it is preferred that the vanadium content is from 0.07 to 0.20%, preferably 0.10 to 0.11%.

Aluminum is usually added for the sake of deoxidation and grain size reduction. To do this, the aluminum content should be no less than 0.015% but no greater than 0.060%, preferably in the range of from 0.023 to 0.032%. Addition of aluminum in excess of 0.060% can produce an unduly large mount of $Al_2O_3$ which is detrimental to fatigue strength and machinability.

Molybdenum is optionally added to improve hardenability, high temperature heat resistance and yield strength. The content of molybdenium is preferably in a range of from 0.02 to 0.15%, most preferably 0.012 to 0.103%. Behavior of molybdenum is inappreciable in a range of below 0.02%, while impact strength is dropped to a great extent in a range of above 0.15%.

Nitrogen is used, in combination with aluminum and vanadium, as a grain size reducer and precipitation promotor. To achieve yield strength of no less than 50 kgf/mm$^2$, the content of nitrogen should be increased up to 0.015%. Undue increase of nitrogen content may, however, cause excessive precipitation of vanadium carbon nitride, thus elevating ductile-brittle transition temperature and raising the potentiality of cracking and fracture. As a consequence, it is desirable to limit the nitrogen content to a range of from 0.0095 to 0.0118%.

Oxygen and non-metallic inclusions are known to produce streak flaw which in turn act to reduce strength. The content of oxygen should therefore be in a range of up to 0.0015%, preferably 0.0011 to 0.0012%, whereas the content of non-metallic inclusions should be no greater than 0.15%, preferably up to 0.07%.

The steel of the composition set forth in detail hereinabove can be produced by virtue of continuous casting rather than ingot casting. As a matter of nature, the continuous casting assures uniform quality and high productivity of steel products. To suppress the oxygen content below 0.0015% and the content of non-metallic inclusions below 0.15%, a low oxygen steel-making process is made use of. The cast steel is then heated: to a temperature of from 1,100° to 1,250° C. It has been discovered that heating the steel to this temperature is economical, easy-to-manage, convenient-to-manipulate and free from any grain size enlargement. The subsequent step is 1:o hot-roll the heated steel at a final rolling temperature of from 850° to 1,000° C. At the hot-rolling step, the total forging ratio should preferably remain more than 10S to make the steel structure uniform. Unit S of the forging ratio herein is defined by the equation: S=S1/S2 wherein S1 denotes the cross-sectional area of a cast steel product before the forging is done and S2 represents the sectional area after the forging has been carried out.

With the prior art process, the cast steel is drawn and then subjected to a controlled rolling at a cooling speed of from 40° to 80° C./min. In contrast, the inventive process has an important feature that the hot-rolled steel is subjected to a normalizing treatment, in lieu of the controlled rolling, within a continuous heat treatment furnace. The temperature of normalizing the steel should preferably range from 880° to 950° C. to ensure balancing of strength and toughness, continuity of heat treatment and augmentation of vanadium carbide precipitation.

A double-sided fan is advantageously employed in air-cooling the normalized steel, the cooling speed being controlled to 5°14 100° C./min such that no or little deviation in mechanical properties may occur from portion to portion of the finished steel product. To avoid irregular distribution of residual stress, the cooling step should continue to be performed until the temperature at the core of a steel product reaches 300° C. or less.

WORKING EXAMPLE

Steels C, D, E and G indicated in Table I were prepared by way of melting raw steel composition through the use of a 60 ton electric furnace and a ladle vacuum degassing equipment and, then, continuously casting the molten steel into a steel product of 177,600 $mm^2$ in cross-sectional area. The cast steel product was heated to a temperature of from 1,100° to 1,250° C. and, subsequently, hot-rolled at a final rolling temperature of from 850° to 1,000° C. into a bar steel of varying diameters as shown in Table II. The bar steel was normalized at a temperature of from 880° to 950° C. by passing it through a continuous heat treatment furnace.

Steels A, B and F are presented as comparative examples against invention steels C, D, E and G. It should be noted that steels A and B are quite similar, in composition, to the commercially available ones. Table II shows mechanical property, surface-versus-core hardness deviation and peafi-ite grain size of the bar steels indicated in Table I. The specimens tested were all taken from ½ radius portion of the respective bar steel, with the impact test specimens being Korean Standard No. 3 and the tensile strength test specimens being Korean Standard No. 4. Table III reveals the length and number of streak flaw found on the stepped or machined away surfaces of the individual steel specimen. The surface defect in a steel product usually depends on the crowdedness of streak flaw.

TABLE I

| Kind Of Steel | Chemical Analysis in Percent by Weight | | | | | | | | | | Non-metallic Inclusions (%) |
|---|---|---|---|---|---|---|---|---|---|---|---|
| | C | Si | Mn | P | S | Mo | V | Al | O | N | |
| A (Compared) | 0.44 | 0.26 | 1.05 | 0.023 | 0.022 | 0.010 | 0.10 | 0.031 | 0.0032 | 0.0073 | 0.120 |
| B (Compared) | 0.45 | 0.26 | 1.04 | 0.016 | 0.020 | 0.006 | 0.10 | 0.033 | 0.0030 | 0.0069 | 0.100 |
| C (Invention) | 0.41 | 0.27 | 1.16 | 0.015 | 0.005 | — | 0.11 | 0.032 | 0.0011 | 0.0102 | 0.058 |
| D (Invention) | 0.42 | 0.26 | 1.22 | 0.013 | 0.007 | 0.012 | 0.10 | 0.027 | 0.0012 | 0.0095 | 0.047 |
| E (Invention) | 0.43 | 0.24 | 1.39 | 0.014 | 0.009 | 0.031 | 0.11 | 0.023 | 0.0009 | 0.0118 | 0.042 |
| F (Compared) | 0.45 | 0.32 | 1.43 | 0.019 | 0.023 | 0.006 | 0.13 | 0.026 | 0.0033 | 0.0067 | 0.217 |
| G (Invention) | 0.44 | 0.28 | 1.19 | 0.016 | 0.008 | 0.103 | 0.11 | 0.025 | 0.0012 | 0.0106 | 0.063 |

TABLE II

| Kind of Steel | Diameter (mm) | Yield Strength ($kgf/mm^2$) | Tensile Strength ($kg/mm^2$) | Elongation (%) | Impact Strength ($kgf \cdot m/cm^2$) | Hardness (HB) | Surface Vs. Core Hardness Deviation (HB) | Pearlite Grain Size (ASTM NO.) |
|---|---|---|---|---|---|---|---|---|
| A* | 105 | 54.3 | 85.6 | 20.6 | 5.0 | 240 | 13 | 7.0 |
| (Compared) | 120 | 52.3 | 83.4 | 20.8 | 5.0 | 238 | 15 | 7.0 |
| B* (Compared) | 115 | 49.4 | 79.9 | 19.6 | 5.0 | 230 | 14 | 7.0 |
| C** (Invention) | 120 | 56.4 | 83.0 | 21.4 | 10.8 | 237 | 6 | 7.5 |
| D** (Invention) | 95 | 56.1 | 82.4 | 22.9 | 10.7 | 227 | 7 | 8.0 |
| E** (Invention) | 120 | 58.9 | 84.6 | 24.1 | 10.1 | 241 | 6 | 8.5 |
| F* (Compared) | 110 | 61.1 | 90.3 | 19.3 | 8.4 | 255 | 7 | 6.0 |
| G** (Invention) | 120 | 59.2 | 87.7 | 20.9 | 10.8 | 247 | 8 | 6.5 |

*: As-rolled
**: As normalized

TABLE III

| Position Measured | Streak Flaw Length (mm) | Number of Streak Flaw Per 100 cm | | | | General Regulation |
|---|---|---|---|---|---|---|
| | | Steel A (Compared) | Steel B (Compared) | Steel C (Invention) | Steel D (Invention) | |
| First | 0.5–1.0 | 0.00 | 0.00 | 0.00 | 0.00 | 6.00 |
| Stepped | 1.0–2.0 | 0.51 | 1.53 | " | " | 1.50 |
| Portion | 2.0–4.0 | 0.51 | 0.00 | " | " | 1.00 |
| | over 4.0 | 0.00 | 0.00 | " | " | 0.00 |
| Second | 0.5–1.0 | 0.00 | 5.10 | " | " | 6.00 |
| Stepped | 1.0–2.0 | 0.00 | 0.73 | " | " | 1.50 |
| Portion | 2.0–4.0 | 0.00 | 0.00 | " | " | 1.00 |
| | over 4.0 | 0.00 | 0.00 | " | " | 0.00 |
| Third | 0.5–1.0 | 1.93 | 2.89 | " | " | 6.00 |
| Stopped | 1.0–2.0 | 0.00 | 0.96 | " | " | 1.50 |
| Portion | 2.0–4.0 | 0.00 | 0.00 | " | " | 1.00 |
| | over 4.0 | 0.00 | 0.00 | " | " | 0.00 |
| Average | 0.5–1.0 | 0.64 | 2.66 | " | " | 6.00 |
| | 1.0–2.0 | 0.17 | 1.07 | " | " | 1.50 |
| | 2.0–4.0 | 0.17 | 0.00 | " | " | 1.00 |
| | over 4.0 | 0.00 | 0.00 | " | " | 0.00 |
| Total Length (mm/100 $cm^2$) | | 1.25 | 3.60 | 0.00 | 0.00 | |

As can be clearly seen in Tables I and III, steels C, D, E and G embodying the invention does not present surface defect, viz., streak flaw, inasmuch as they contain minimal amount of sulfur, oxygen and non-metallic inclusions. It can be further confirmed in Table II that steels C, D, E and G exhibit impact strength of more than 10.0 kgf·m/$cm^2$, while keeping tensile strength as great as 80 kgf/$mm^2$ or more. Particularly, impact strength of the invention steels is almost twice as great as that of compared steels A, B and F.

In addition to the above, the invention steels exhibit a significantly reduced degree of surface-to-core hardness deviation. Steel G shows that improvement in impact strength can be fulfilled with no degradation of toughness by adding a large amount of molybdenum. It is important to note that the invention steels achieve good strength and excellent toughness without having to use such microalloy elements as chromium, titanium, niobium, calcium, rare earth metal and misch metal.

While the invention has been described with reference to a preferred embodiment, it should be apparent to those skilled in the art that many changes and modifications may be made without departing from the spirit and scope of the invention as defined in the claims.

What is claimed is:

1. A thermal refiningless, hot-rolled steel exhibiting impact strength in excess of 10 kgf·m/$cm^2$ and consisting essentially of, expressed in terms of weight percent, 0.30–0.50% carbon, 0.15–0.60% silicon, 0.80–1.60% manganese, up to 0.02% phosphorous, up to 0.015%sulfur, 0.07–0.20% vanadium, 0.015–0.06% aluminum, 0.005–0.015% nitrogen, up to 0.0015% oxygen, 0.02–0.15% molybdenum, the balance iron and unavoidable impurities.

2. The steel as recited in claim 1, wherein the carbon is present in a range of 0.41–0.44% by weight.

3. The steel as recited in claim 1 wherein the sulfur is present in a range of 0.005–0.008% by weight.

4. The steel as recited in claim 1 wherein the oxygen is present in a range of 0.0011–0.0012% by weight.

5. A method of making a thermal refiningless, hot-rolled steel exhibiting impact strength in excess of 10kgf·m/$cm^2$ and consisting essentially of, expressed in terms of weight percent, 0.30–0.50% carbon, 0.15–0.60% silicon, 0.80–1.60% manganese, up to 0.02% phosphorus, up to 0.015% sulfur, 0.07–0.20% vanadium, 0.015–0.06% aluminum, 0.005–0.015% nitrogen, up to 0.0015% oxygen, 0.02–0.15% molybdenum, the balance iron and unavoidable impurities, the method consisting of the steps of: casting a molten steel into a steel product having oxygen content of up to 0.0015 wt %; heating the steel product up to a temperature of 1,100°–1,250° C.; 1,250° C.; hot-rolling the heated steel product at a final rolling temperature of 850°–1,000° C.; and normalizing the hot-rolled steel product at a temperature of 880°–950° C.

6. The method as recited in claim 5, wherein the heated steel product is hot-rolled to a total forging ratio of more than 10S.

7. The method as recited in claim 5 further comprising the step of cooling the normalized steel product down to 300° C. or less at a cooling speed 5°–100° C./min..

* * * * *